US010926563B2

(12) United States Patent
Hirai et al.

(10) Patent No.: US 10,926,563 B2
(45) Date of Patent: Feb. 23, 2021

(54) INK JET PRINTING APPARATUS, CONTROL METHOD THEREOF AND STORAGE MEDIUM

(71) Applicant: CANON KABUSHIKI KAISHA, Tokyo (JP)

(72) Inventors: Yoshiyuki Hirai, Kunitachi (JP); Yoichiro Makino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/513,922

(22) Filed: Jul. 17, 2019

(65) Prior Publication Data

US 2020/0039262 A1 Feb. 6, 2020

(30) Foreign Application Priority Data

Aug. 1, 2018 (JP) ..... JP2018-145449

(51) Int. Cl.

| | |
|---|---|
| ***B41J 29/393*** | (2006.01) |
| ***B41J 11/00*** | (2006.01) |
| ***B41J 3/46*** | (2006.01) |

(52) U.S. Cl.

CPC ..... *B41J 29/393* (2013.01); *B41J 3/46* (2013.01); *B41J 11/0095* (2013.01); *B41J 2029/3935* (2013.01)

(58) Field of Classification Search

CPC ... B41J 29/393; B41J 2029/3935; B41J 29/38
See application file for complete search history.

(56) References Cited

U.S. PATENT DOCUMENTS

| | | | | |
|---|---|---|---|---|
| 5,427,461 | A | 6/1995 | Hirai et al. | |
| 5,434,602 | A | 7/1995 | Kaburagi et al. | |
| 7,097,272 | B2 | 8/2006 | Yoshida et al. | |
| 8,991,969 | B2 | 3/2015 | Bannai et al. | |
| 2005/0270325 | A1* | 12/2005 | Cavill | B41J 29/393 347/19 |
| 2011/0234677 | A1* | 9/2011 | Tokunaga | B41J 29/393 347/19 |
| 2014/0233071 | A1* | 8/2014 | Kido | H04N 1/3878 358/3.26 |
| 2015/0174934 | A1* | 6/2015 | Bogart | B41J 29/393 347/19 |

FOREIGN PATENT DOCUMENTS

JP 2011-011381 A 1/2011

* cited by examiner

*Primary Examiner* — Lam S Nguyen
(74) *Attorney, Agent, or Firm* — Venable LLP

(57) ABSTRACT

The ink jet printing apparatus has: an analysis unit configured to analyze whether there is an error relating to a pattern based on image data read by a reading unit; a classification unit configured to classify whether an error of analysis results by the analysis unit is an error that a user can cope with; and a control unit configured to perform control to, in a case where an error of classification results by the classification unit is an error that a user can cope with, display a coping method thereof on the display unit, and to, in a case where an error of classification results by the classification unit is not an error that a user can cope with, advance processing to processing other than printing position adjustment processing included in a setup without adjusting a printing position of a print head.

20 Claims, 16 Drawing Sheets

801

802

803

804

805

806

INK JET PRINTING APPARATUS, CONTROL METHOD THEREOF AND STORAGE MEDIUM

BACKGROUND OF THE INVENTION

Field of the Invention

The present invention relates to a technique for adjusting a printing position of a print head that prints an image by ejecting ink.

Description of the Related Art

It is possible for a printing apparatus to perform printing without touching a sheet (printing medium) by ejecting ink from a print head. For the printing apparatus, there is a technique to increase the landing accuracy on a printing medium by performing adjustment of the print head (hereinafter, called head adjustment) for each print color in order to improve the print image quality. As the head adjustment technique, there is a method of performing head adjustment by a user printing a pattern for head adjustment on a printing medium by an ink jet printer including a scanner device, placing the printed printing medium on a document table of the scanner, and scanning the printed printing medium. Hereinafter, this method is called semi-automatic head adjustment.

The semi-automatic head adjustment is effective for improving the image quality of printing performed afterward in a case where a user performs the semi-automatic head adjustment in a setup performed first (hereinafter, called initial setup) in order to bring an ink jet MFP into a usable state after purchasing the MFP.

The semi-automatic head adjustment does not require an optical sensor to be mounted on a carriage and it is also not necessary for a user to check a print pattern of a head adjustment sheet by visual inspection, which is necessary in manual head adjustment. Because of this, there is a case where this method is adopted in an ink jet printer (hereinafter, called ink jet MFP) (see Japanese Patent Laid-Open No. 2011-11381).

SUMMARY OF THE INVENTION

As the ink jet MFP prevails in recent years, further improvement of usability in a case where semi-automatic head adjustment has failed is demanded. The present invention provides a technique to improve usability in an initial setup including semi-automatic head adjustment.

The ink jet printing apparatus according to an aspect of the present invention is an ink jet printing apparatus including a reading unit configured to read a printing medium on which a pattern for adjusting a printing position of a print head is printed and a display unit configured to display information in accordance with reading results of the reading unit, and in which a setup including adjustment processing of the print head is performed, and the printing apparatus has: an analysis unit configured to analyze whether there is an error relating to the pattern based on image data read by the reading unit; a classification unit configured to classify whether an error of analysis results by the analysis unit is an error that a user can cope with; and a control unit configured to perform control to, in a case where an error of classification results by the classification unit is an error that a user can cope with, display a coping method thereof on the display unit, and to, in a case where an error of classification results by the classification unit is not an error that a user can cope with, advance processing to processing other than adjustment processing of the print head, which is included in the initial setup, without adjusting a printing position of the print head.

Further features of the present invention will become apparent from the following description of exemplary embodiments with reference to the attached drawings.

DESCRIPTION OF THE EMBODIMENTS

In the following, embodiments of the present invention are explained with reference to the drawings. Note that components described in these embodiments are merely exemplary and not intended to limit the scope of the present invention to those. Further, all combinations of components explained in the embodiments are not necessarily indispensable to the solution to solve the problem and it is possible to make various modifications and changes within the scope of the gist of the present invention described in the scope of the claims.

First Embodiment

In the present embodiment, a case is explained where the present invention is applied to an ink jet MFP, which is an ink jet printing apparatus.

Figure 1A:
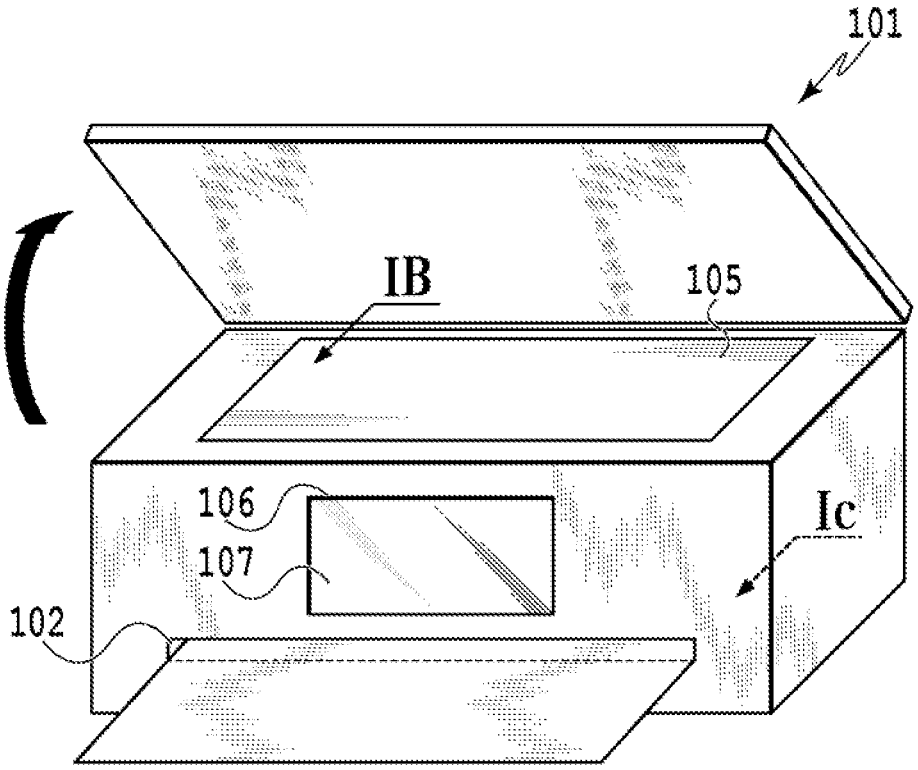
FIG. 1A to FIG. 1C are schematic diagrams of an ink jet MFP.
Figure 1B:
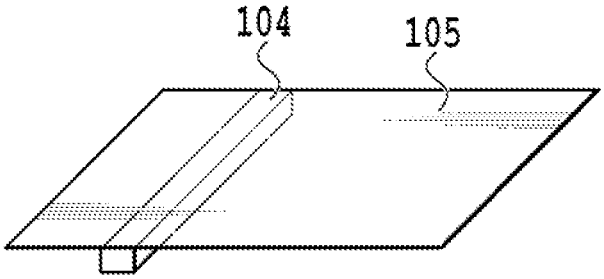
Figure 1C:
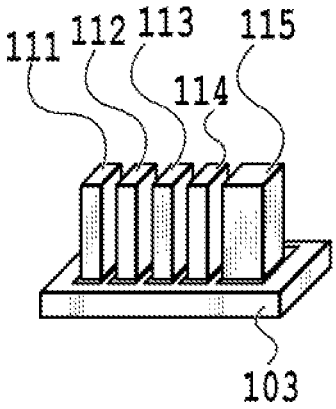

FIG. 1A to FIG. 1C are schematic diagrams of the ink jet MFP according to the present embodiment. FIG. 1A shows the entire ink jet MFP, FIG. 1B shows a scanner unit of the ink jet MFP, and FIG. 1C shows a print head of the ink jet MFP.

An ink jet MFP 101 includes a printing unit 102, a print head 103, a scanner unit 104, a document table 105, a display unit 106, and an operation unit 107.

The ink jet MFP 101 includes the printing unit 102 configured to feed and discharge a printing sheet (printing medium) and perform printing, and the print head 103 that ejects ink onto a printing sheet. To the print head 103, for example, ink tanks 111 to 115 storing dye cyan, dye magenta, dye yellow, dye black, and pigment black, respectively, are attached. The print head 103 is provided with ejection ports (not shown schematically) through which ink droplets are ejected. Further, the ink jet MFP 101 includes the scanner unit 104 configured to scan a document sheet by an optical sensor and the document table 105 on which a document sheet is mounted for the scanner unit 104 to scan the document sheet. Further, on the front side of the ink jet MFP 101, the display unit 106 is provided. The display unit 106 is, for example, a liquid crystal display or the like and a device capable of displaying information in accordance with reading results of the scanner unit 104. As the information in accordance with the reading results of the scanner unit 104, mention is made of, for example, a guide screen of characters and illustrations relating to the semi-automatic head adjustment processing, a caution screen of an error and the like, a warning screen, and the like. The display unit 106 is a touch panel device and includes functions as the operation unit 107 for a user to operate the ink jet MFP 101.

In the present embodiment, although explanation is given on the assumption that the scanner unit 104 and the document table 105 adopt the flat bed system, it is also possible to apply a scanner unit adopting the ADF (Auto Document Feeder) system to the present embodiment. Further, in the present embodiment, although explanation is given on the assumption that the display unit 106 and the operation unit 107 adopt the touch panel system, it is also possible to apply the operation unit 107 adopting the hard key system to the present embodiment.

Furthermore, the ink jet MFP 101 includes the head adjustment function to improve the landing accuracy on a printing medium by performing adjustment for each color of ink ejected from the print head 103 in order to improve the print image quality. The head adjustment is performed by a method in which a head adjustment sheet 201 on which a print pattern for head position adjustment is printed is printed by the ink jet MFP 101 and a user places the printed matter on the document table 105 and the scanner unit 104 scans the printed matter and analyzes the print pattern. In this method, the analysis of the print pattern is performed automatically and mounting of the head adjustment sheet 201 on the document table 105 is the work of a user and performed manually, and therefore, in the present embodiment, the head adjustment method is called semi-automatic head adjustment.

Figure 2:
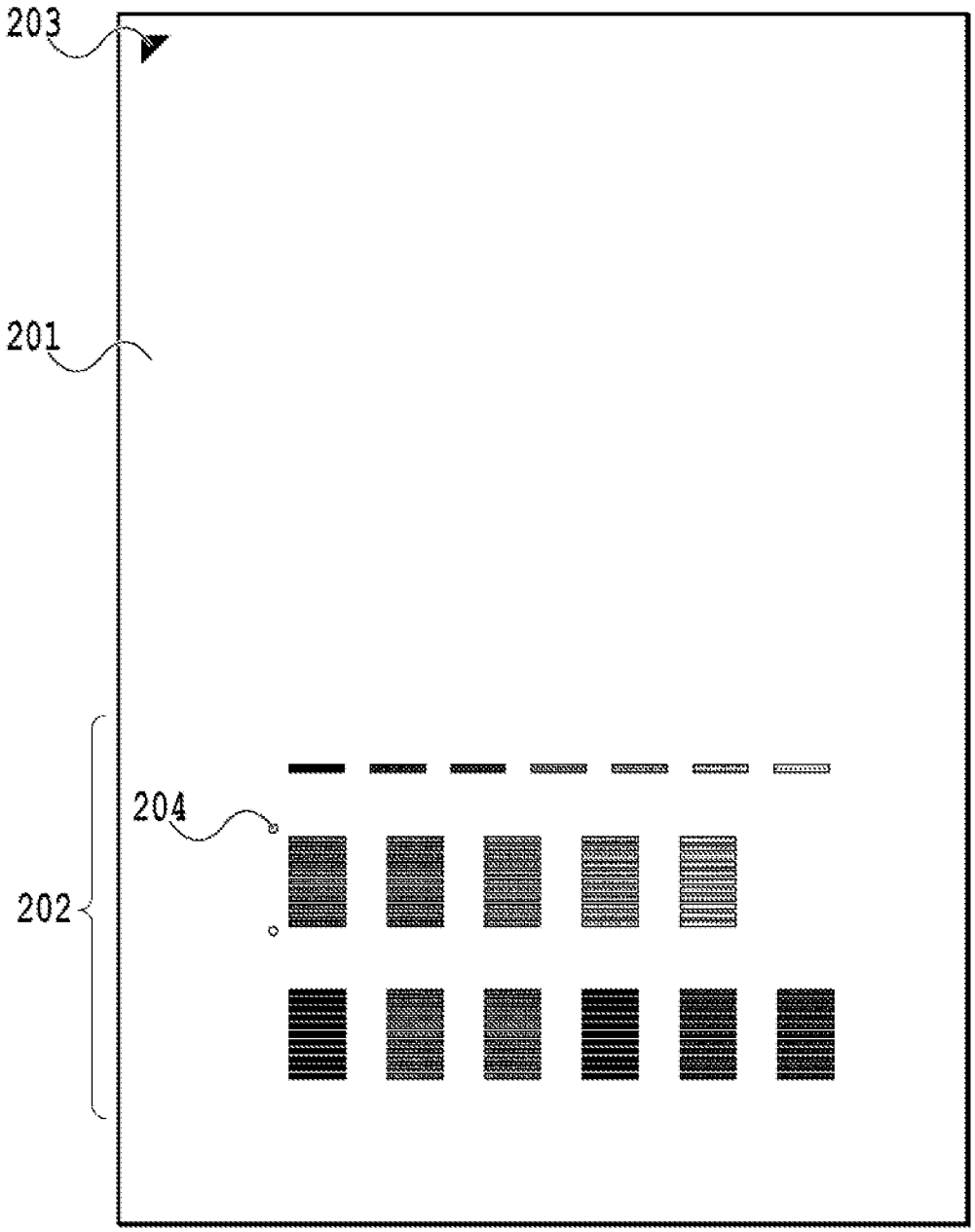
FIG. 2 is a schematic diagram of a head adjustment sheet.

FIG. 2 is a schematic diagram of the surface side of the printing medium on which a pattern for head adjustment is printed (hereinafter, called head adjustment sheet). The head adjustment sheet 201 is a sheet for performing semi-automatic head adjustment. The head adjustment sheet 201 has a pattern for registration adjustment (hereinafter, referred to as registration adjustment pattern) 202 that is an area in which a print pattern for head position adjustment is printed. Further, the head adjustment sheet 201 includes an abutting position indication mark 203 that guides the orientation and the position for placing the head adjustment sheet 201 on the document table 105. Furthermore, the head adjustment sheet 201 has a position reference mark 204 for identifying that the printing medium is a printing medium on which the head adjustment sheet 201 is printed.

The data of the head adjustment sheet 201 is stored in a ROM 302, to be described later, and printing processing at S501 is performed by a CPU 301 reading the data of the head adjustment sheet 201 from the ROM 302 at the time of semi-automatic head adjustment processing, to be described later.

In the present embodiment, the contents of the registration adjustment pattern 202 of the head adjustment sheet 201 are not specified in particular. It is also possible to apply even the head adjustment sheet 201 that omits the abutting position indication mark 203 to the present embodiment. On the backside of the head adjustment sheet 201, nothing is printed and there is no pattern unlike the surface side.

Figure 3:
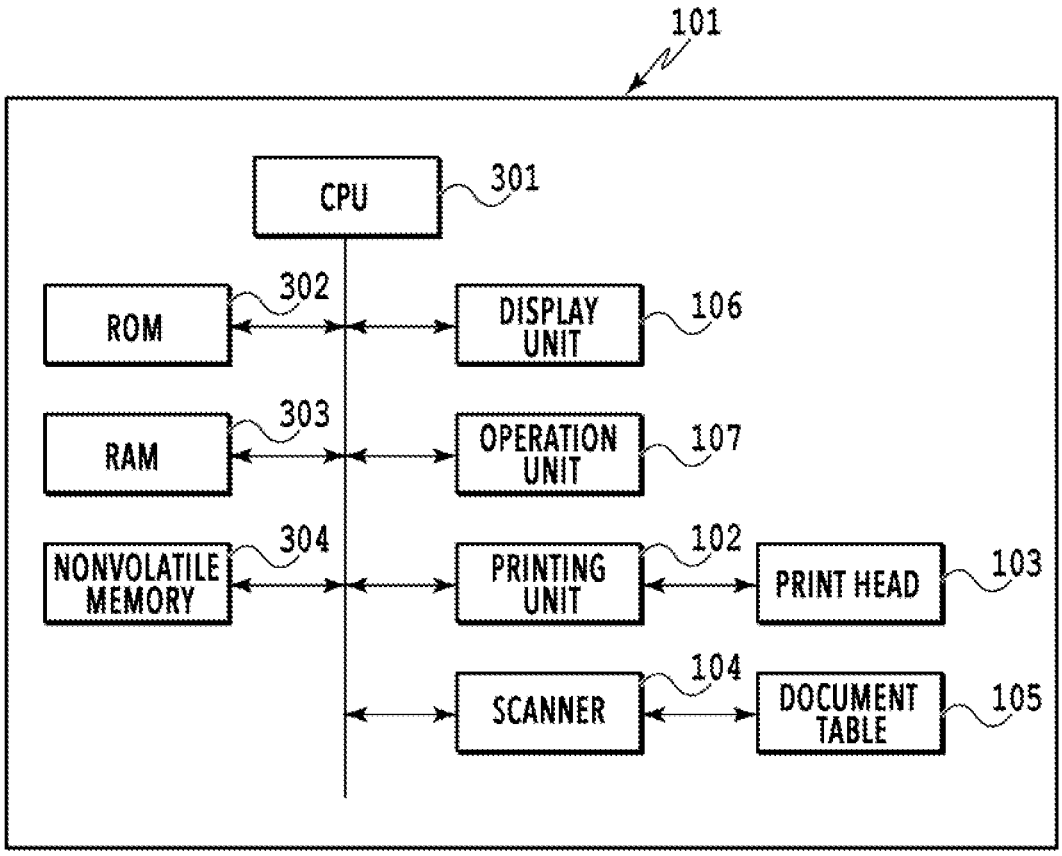
FIG. 3 is a block diagram showing an outline configuration of the ink jet MFP.

FIG. 3 is a block configuration diagram showing an outline configuration of the ink jet MFP 101. The ink jet MFP 101 includes the CPU 301, the ROM 302, a RAM 303, a nonvolatile memory 304, the printing unit 102, the print head 103, the scanner unit 104, the document table 105, the display unit 106, and the operation unit 107. The CPU 301 loads a program stored in the ROM 302 onto the RAM 303 and generates a print job for the printing unit 102 to print the head adjustment sheet 201. Further, the CPU 301 loads a program stored in the ROM 302 onto the RAM 303 and generates a head adjustment sheet analysis job in which the scanner unit 104 performs head adjustment by scanning the head adjustment sheet 201 placed on the document table 105. Furthermore, the CPU 301 loads a program stored in the ROM 302 onto the RAM 303 and performs display processing relating to the operation of semi-automatic head adjustment and the execution results notification in the display unit 106 and the operation unit 107.

Figure 4:
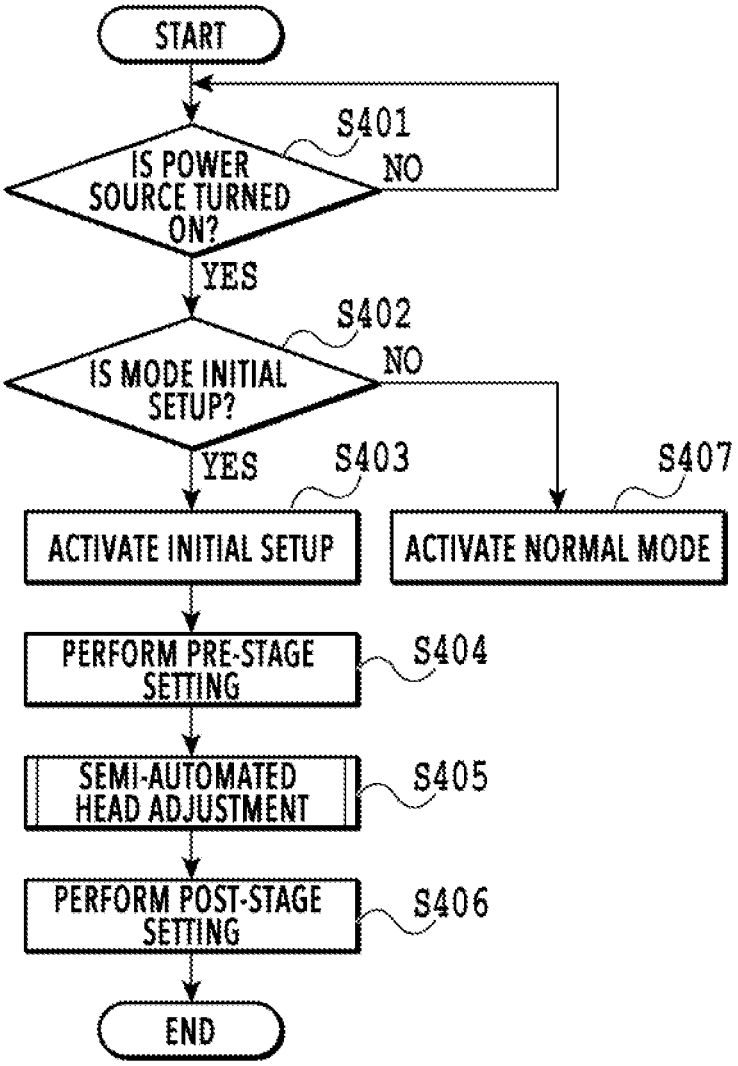
FIG. 4 is a flowchart showing an initial setup processing procedure example.

FIG. 4 is a flowchart showing an outline of a processing procedure example of the initial setup in the ink jet MFP according to the present embodiment. The processing of the flowchart of the present embodiment is implemented by the CPU 301 reading and executing a program relating to the flowchart. In the following explanation of the flow, symbol "S" represents a step.

The initial setup is a setup for a user to perform first setting so as to bring a state where various functions, such as the print function and the scan function, can be performed by causing the ink jet MFP 101 to operate at the time of receiving and installing the ink jet MFP 101. Further, the initial setup is a setup that needs to be performed without exception in order to bring the ink jet MFP 101 into a usable state. Because of this, the initial setup is distinguished from the common setup to change the setting of the ink jet MFP 101 after the initial setup is terminated. That is, it can also be said that the initial setup is setup processing performed at the time of turning on the power source for the first time after taking out the ink jet MFP 101 from the packing box (after the ink jet MFP 101 has arrived). In a case where the initial setup of the ink jet MFP 101 is not completed yet, the initial setup is performed even in a case where the power source is turned on for the second time or later.

In the following, an outline of a processing procedure example of the initial setup is explained. In the present embodiment, the CPU 301 determines whether or not the power source of the ink jet MFP 101 is in the on state (S401) and after the power source enters the on state and the state where power is supplied is brought about, the processing at S402 and subsequent steps is performed. That is, in a case where the power source is in the on state (S401: YES), the CPU 301 advances the processing to S402. In a case where the power source is in the off state, not in the on state (S401: NO), at S401 also, the state of the power source is determined.

The work process before the installation of the ink jet MFP 101, which is performed before S401, such as the process to take out the ink jet MFP from a box and the process to remove the buffering member, the protective seal, and the like protecting the ink jet MFP, is not specified in particular in the present embodiment.

In a case where the power source of the ink jet MFP 101 enters the on state, following this, the CPU 301 determines whether to activate the initial setup (S403) or the normal mode (S407) of the ink jet MFP 101 (S402). The determination condition at S402 is whether or not the initial setup is completed to the end for the ink jet MFP 101. In the present embodiment, the completion of the initial setup is on the condition that the processing at all steps up to post-stage setting (S406) is performed. Because of this, in a case where the power source of the ink jet MFP 101 enters the off state before the post-stage setting (S406) is completed and the initial setup is suspended, the initial setup is not regarded as having been completed. Consequently, after this, in a case where the power source of the ink jet MFP 101 is brought into the on state, based on results of the determination at S402, the CPU 301 advances the processing to the initial setup activation (S403) again. Information indicating that the initial setup is completed is stored in the nonvolatile memory 304 at the time of the completion of execution of the post-stage setting (S406). Because of this, the information indicating that the initial setup is completed is not lost and kept even in a case where the power source of the ink jet MFP 101 enters the off state. That is, S402 is implemented by determining whether or not the information indicating that the initial setup is completed is held. This may also be determined based on, for example, an initial setup completion flag.

In the present embodiment, although the case is explained where the determination condition of the initial setup mode at S402 is the completion of the post-stage setting (S406), the case is not limited to this. For example, it is also possible to include processing not described in the flowchart in FIG. 4 and the presence/absence of setting in the determination condition at S402. Further, it may also be possible to take whether or not up to S405 that is a step on the way in the flowchart in FIG. 4 is performed as the completion condition of the initial setup.

At S403, the CPU 301 activates the initial setup. That is, at S403, only the minimum processing is performed, which is necessary at the time of the initial setup of the ink jet MFP 101, such as processing to display that the power source of the ink jet MFP 101 is brought into the on state on the display unit 106.

The processing contents of the initial setup activation (S403) are not specified in particular in the present embodiment. It is also possible to make the processing contents of the initial setup activation (S403) the same as the processing contents of the normal activation (S407).

In a case where the initial setup activation (S403) is completed, the CPU 301 continuously performs the first setting necessary for the initial setup (S404). In the present embodiment, this is defined as pre-stage setting. As the processing performed in the pre-stage setting (S404), mention is made of selection of a language displayed on the display unit 106, attachment of an ink tank to the print head 103, display processing for causing the printing unit 102 to set an appropriate printing sheet, and the like.

In the present embodiment, although the case is explained where the setting contents performed in the pre-stage setting at S404 are setting of a language and attachment of an ink tank, the case is not limited to this. For example, in a case where the language is determined in accordance with the area to which the ink jet MFP 101 is shipped, it may also be possible to skip the language selection. Information on the area to which the ink jet MFP 101 is shipped is stored in the nonvolatile memory 304 at the time of shipment of the ink jet MFP 101. Because of this, in a case where the pre-stage setting at S404 is performed, on a condition that the shipment destination area is Japan, it is possible to skip the pre-stage setting of the Japan area by automatically selecting Japanese in language selection. Further, in a case where the ink jet MFP 101 is shipped in the state where an ink tank is attached to the print head 103, it is possible to skip the pre-stage setting. That is, it is possible to apply even the specifications in which the pre-stage setting at S404 is skipped to the present embodiment.

In a case where the pre-stage setting (S404) is completed, the CPU 301 performs semi-automatic head adjustment (S405). The semi-automatic head adjustment (405) is the main portion of the present embodiment and details will be described later.

In a case where the semi-automatic head adjustment (S405) is completed, the CPU 301 continuously performs the post-stage setting (S406). In the post-stage setting (S406), the CPU 301 performs setting relating to network connection of the ink jet MFP 101, and the like. In a case where the post-stage setting (S406) is completed, the CPU 301 stores information indicating that the initial setup is completed in the nonvolatile memory 304 and this flow is terminated.

As described above, in a case where the processing from the pre-stage setting (S404) to the post-stage setting (S406) is completed once, the information indicating that the initial setup is completed is stored in the nonvolatile memory 304. By referring to this information, the CPU 301 determines that the entire initial setup is completed. As a result of this, in a case where the power source of the ink jet MFP 101 enters the on state the next time, the CPU 301 determines that the initial setup activation is not necessary in the determination of whether to activate the initial setup (S402) and determines to activate the normal mode. Then, the CPU 301 advances the processing to the normal activation (S407).

In the present embodiment, the processing contents of the post-stage setting (S406) are not specified in particular. For example, it may also be possible to skip the network setting. Further, it is also be possible to apply the specifications in which the post-stage setting (S406) includes another setting item to the present embodiment.

In the present embodiment, although the setting item performed before the semi-automatic head adjustment (S405) is defined as the pre-stage setting (S404) and the setting item performed after the semi-automatic head adjustment is defined as the post-stage setting (S406) in the initial setup, these setting contents may be performed in any order.

Figure 5:
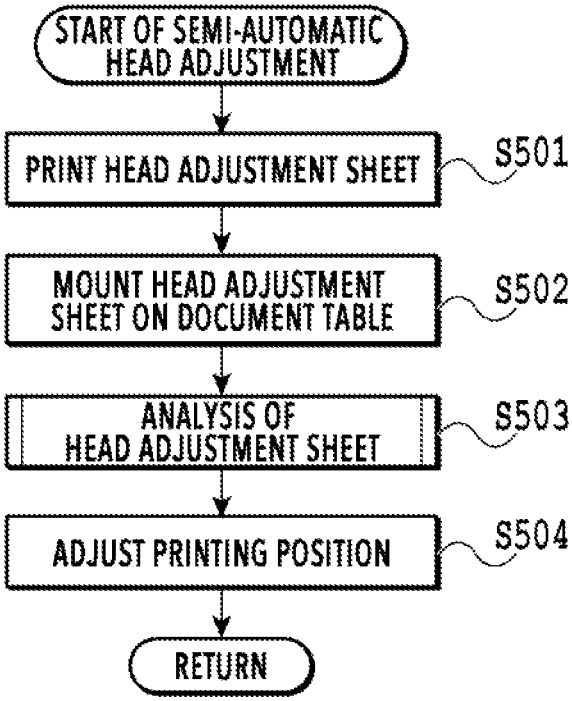
FIG. 5 is a flowchart showing an outline of a semi-automatic head adjustment processing procedure example.
Figure 6A:
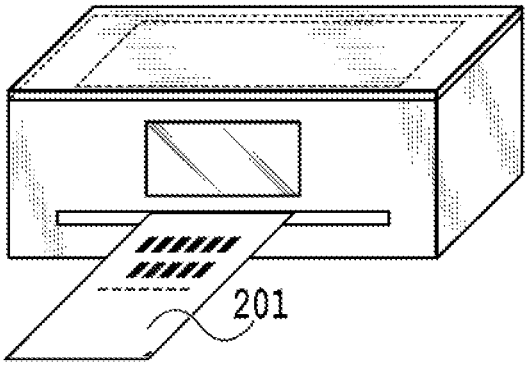
FIG. 6A to FIG. 6C are explanatory diagrams of a semi-automatic head adjustment processing procedure example.
Figure 6B:
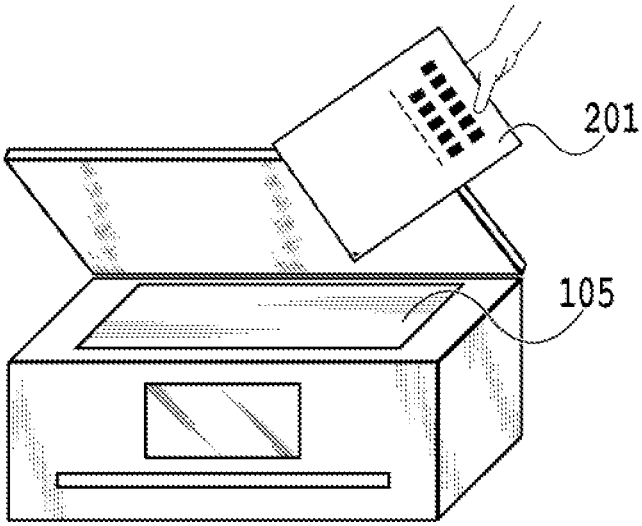
Figure 6C:
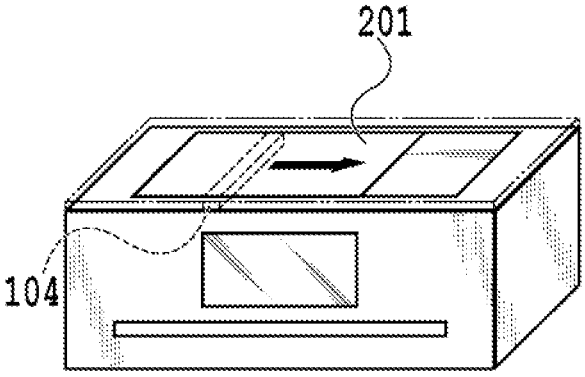

An outline of the semi-automatic head adjustment that is the main portion of the present embodiment is explained with reference to FIG. 5 and FIG. 6A to FIG. 6C. FIG. 5 is a flowchart showing a processing procedure example of the semi-automatic head adjustment. FIG. 6A to FIG. 6C are explanatory diagrams of the processing procedure example of the semi-automatic head adjustment. FIG. 6A shows a state where the head adjustment sheet is printed, FIG. 6B shows a state where the head adjustment sheet is mounted on a document table, and FIG. 6C shows a state where the head adjustment sheet is analyzed.

In a case where the semi-automatic head adjustment is divided roughly, the semi-automatic head adjustment includes four processes: "printing of head adjustment sheet (S501)", "mounting of head adjustment sheet on document table (S502)", "analysis of head adjustment sheet (S503)", and "head position adjustment (S504)".

"Printing of Head Adjustment Sheet (S501)"

As the first processing of the processing at S405 described above in FIG. 4, the CPU 301 performs printing processing of the head adjustment sheet 201 (S501). In order to print the head adjustment sheet 201, it is necessary to bring about the state where printing is possible by attaching an ink tank to the print head 103, and so on, and for an appropriate printing sheet to be set to the printing unit 102.

"Mounting of Head Adjustment Sheet on Document Table and Scan Processing (S502)"

Following the above, the head adjustment sheet 201 is mounted on the document table 105 by a user. It is necessary for a user to mount the head adjustment sheet 201 correctly on the document table 105 with reference to the abutting position indication mark 203 of the head adjustment sheet 201, and the like. After this, a user gives instructions to start a scan by operating the operation unit. By the instructions, the CPU 301 performs scan processing by using the scanner unit 104 (S502).

"Analysis of Head Adjustment Sheet (S503)"

Following the above, at S503, the CPU 301 performs the analysis of the head adjustment sheet 201. The analysis of the head adjustment sheet 201 is performed by using scan results obtained by scanning the head adjustment sheet 201 mounted on the document table 105 by the scanner unit 104. In order to cause the analysis of the head adjustment sheet 201 to succeed, it is necessary to print the head adjustment sheet 201 correctly at S501 and for a user to mount the head adjustment sheet 201 correctly on the document table 105.

"Printing Position Adjustment of Print Head (S504)"

Following the above, at S504, in accordance with the results of the analysis performed at S503, the printing position adjustment of the print head 103 is performed.

Here, in a case where the operation of a user to mount the head adjustment sheet on the document table has failed, it is sufficient to mount the head adjustment sheet 201 again, and therefore, it is possible to comparatively easily cope with the failure by performing the processing again. Note that, in a case where the process of "printing of head adjustment sheet (S501)" has failed, it is difficult to cope with the failure by performing the processing again. As an example in which it is difficult to cope with the failure by performing the processing again, there is a case where the printing sheet on which the head adjustment sheet 201 is printed is stained, a case where the registration adjustment pattern 202 is imperfect due to no ejection of ink from the print head 103, or the like. Further, there is also a case where the printing sheet on which the head adjustment sheet 201 is printed is incompatible. In these cases, it is necessary to exchange the sheet on which the head adjustment sheet 201 is printed with another appropriate sheet, to refresh the print head, and so on, and therefore, it is difficult for a user to specify the cause during the initial setup and to appropriately cope with the failure by performing the processing again.

Because of this, in the present embodiment, in accordance with the results of the analysis in the "analysis of head adjustment sheet (S503)" process, a notification is given to a user so as prompt the user to perform the processing again, or the above-described process is skipped.

Figure 7:
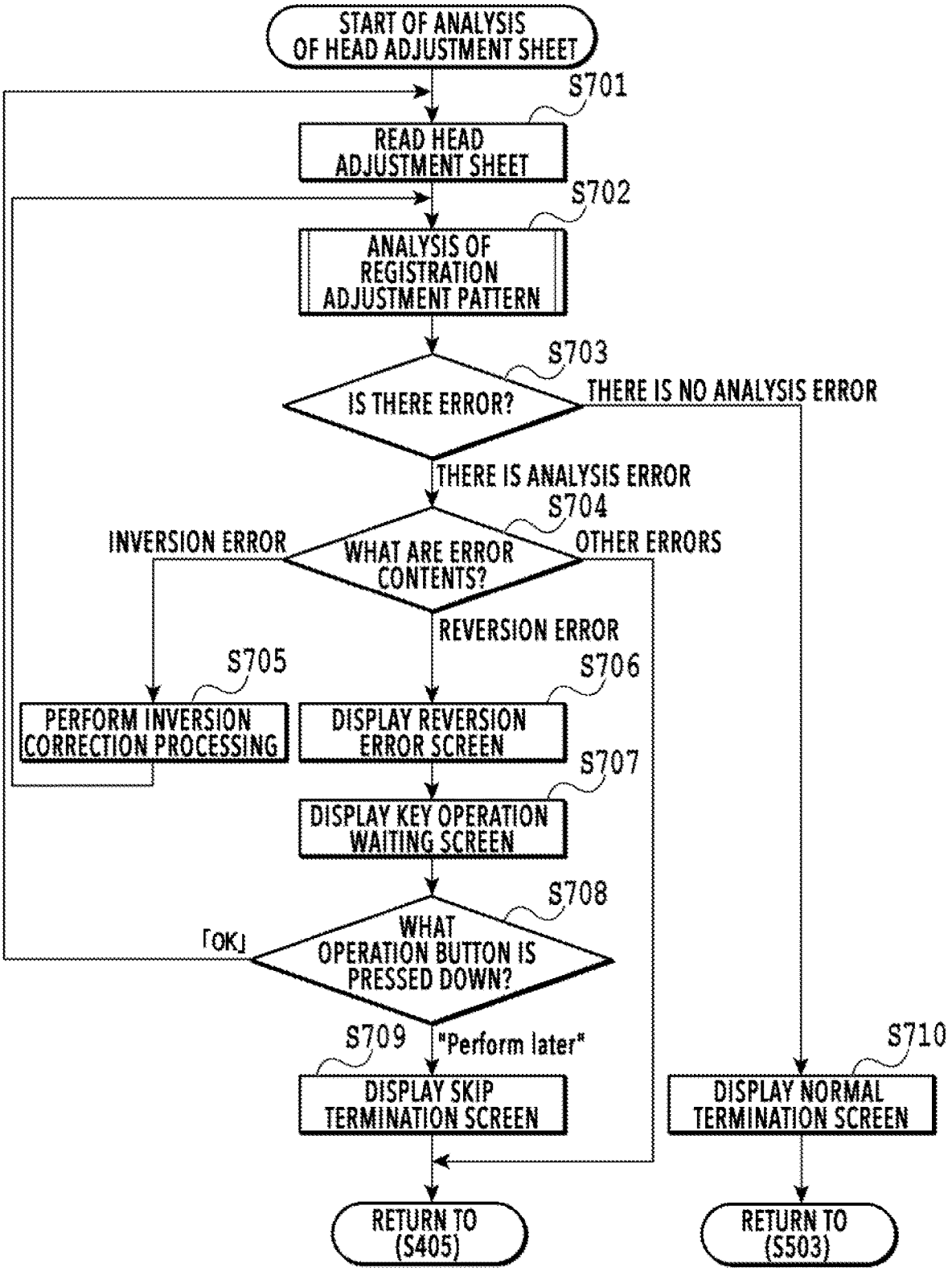
FIG. 7 is a flowchart showing an analysis processing procedure example of a head adjustment sheet.
Figure 8A:
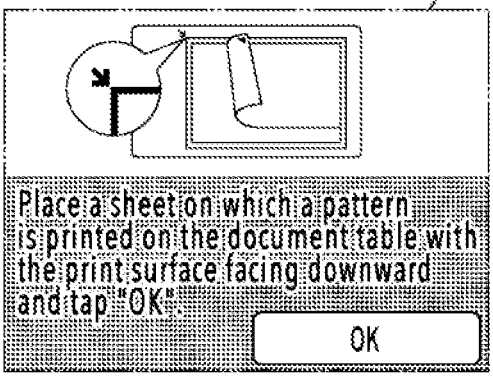
FIG. 8A to FIG. 8F are each a UI example displayed in an analysis processing procedure of a head adjustment sheet.
Figure 8B:
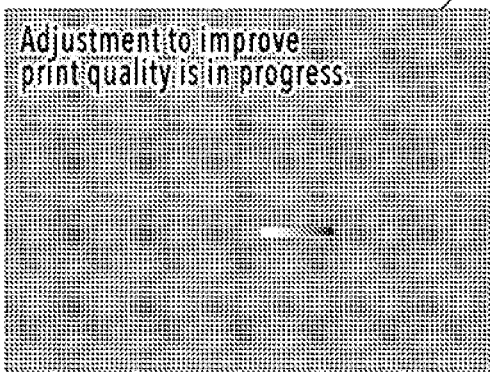
Figure 8C:
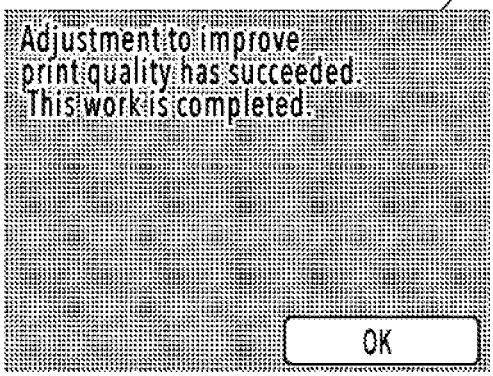
Figure 8D:
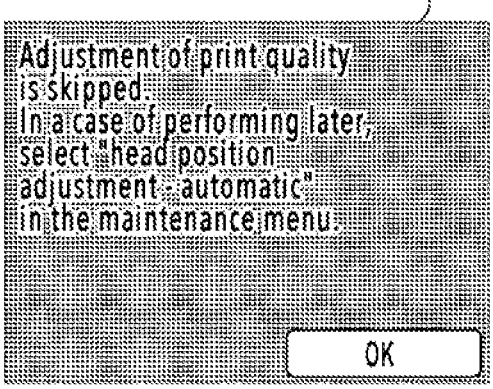
Figure 8E:
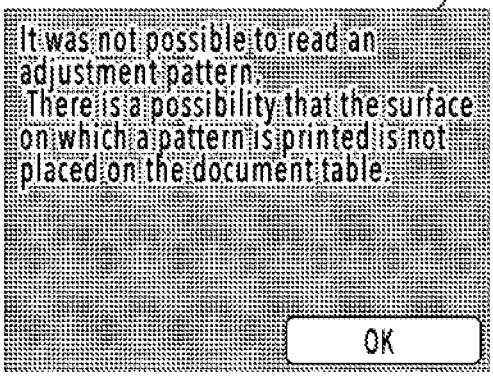
Figure 8F:
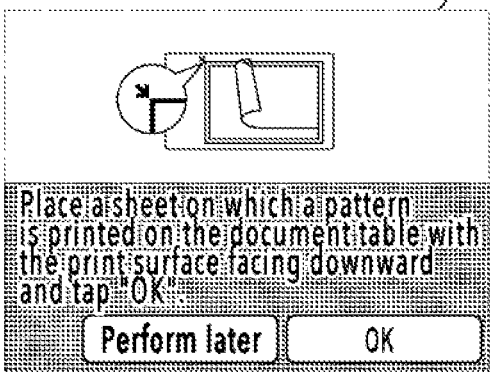

Details of the "analysis of head adjustment sheet (S503)" process are explained by using FIG. 7 and FIG. 8A to FIG. 8F. FIG. 7 is a flowchart showing an analysis processing procedure example of the head adjustment sheet. FIG. 8A to FIG. 8F are each a diagram showing an UI example displayed in the analysis processing procedure of the head adjustment sheet. FIG. 8A shows an example of a reading start check screen, FIG. 8B shows an example of a reading-in-progress screen, and FIG. 8C shows an example of a normal termination screen. FIG. 8D shows an example of a skip termination screen, FIG. 8E shows an example of a screen of an error in which the surface faces downward (hereinafter, reversion error screen), and FIG. 8F shows an example of a key operation waiting screen.

At S701, the CPU 301 performs reading of a range including the registration adjustment pattern 202 on the surface side (side that comes into contact with the document table 105) of the head adjustment sheet 201 mounted on the document table 105. Before S701 is performed, on the display unit 106 of the ink jet MFP 101, for example, as shown in FIG. 8A, a reading start check screen 801 is displayed. In a case where a user selects an OK button on the reading start check screen 801, triggered by this operation of the user, the scanner unit 104 scans the head adjustment sheet 201 mounted on the document table 105. By the scan, the image data of the head adjustment sheet 201 is acquired. The acquired image data of the head adjustment sheet 201 is stored in the RAM 303.

At S702, the CPU 301 performs analysis processing of the registration adjustment pattern (hereinafter, also referred to as registration pattern analysis processing) for the image data of the head adjustment sheet 201, which is acquired at S701. At this time, on the display unit 106, for example, as shown in FIG. 8B, a reading-in-progress screen 802 is displayed.

Figure 9:
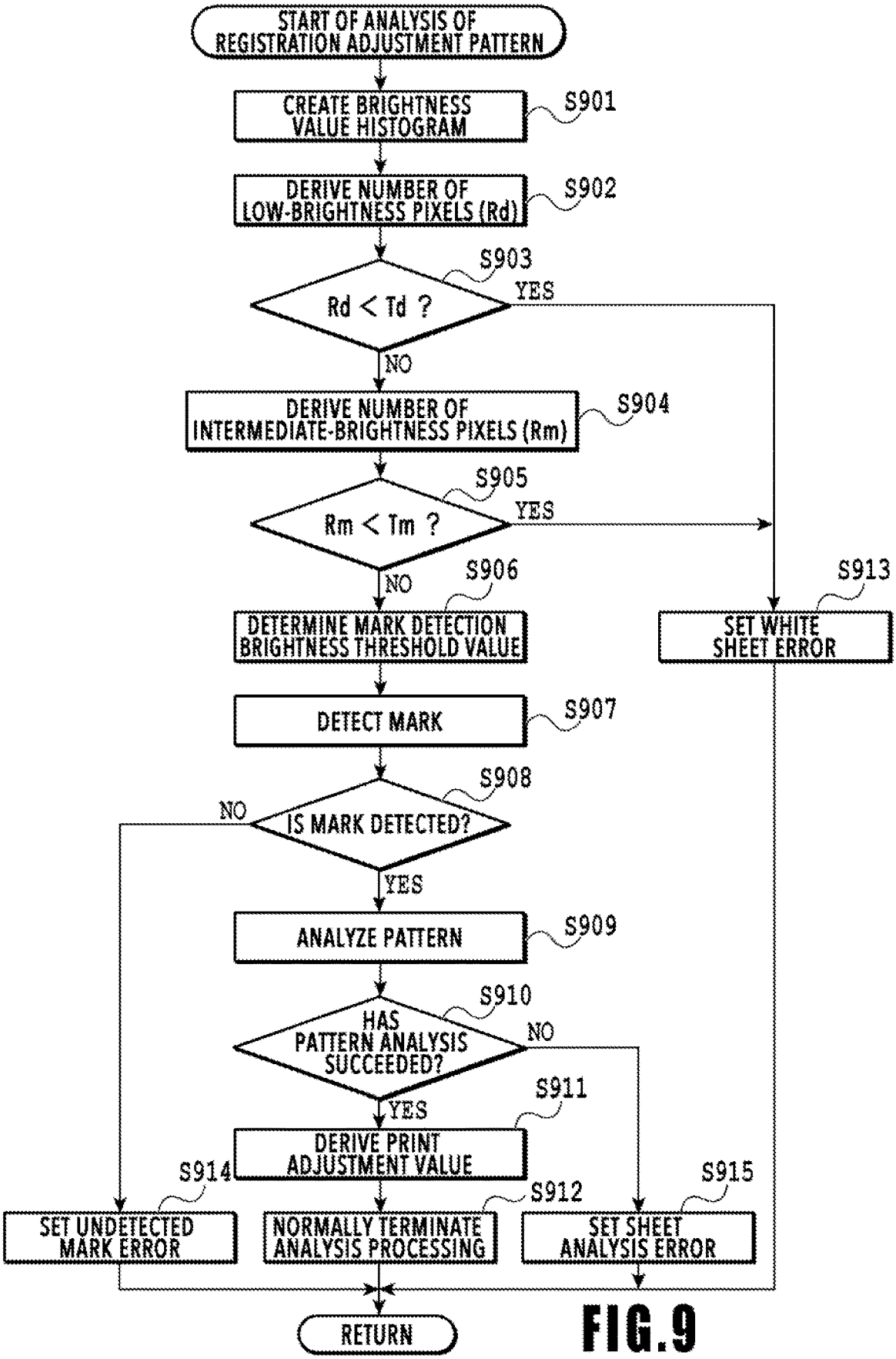
FIG. 9 is a flowchart showing an analysis processing procedure example of a registration adjustment pattern.
Figure 13:
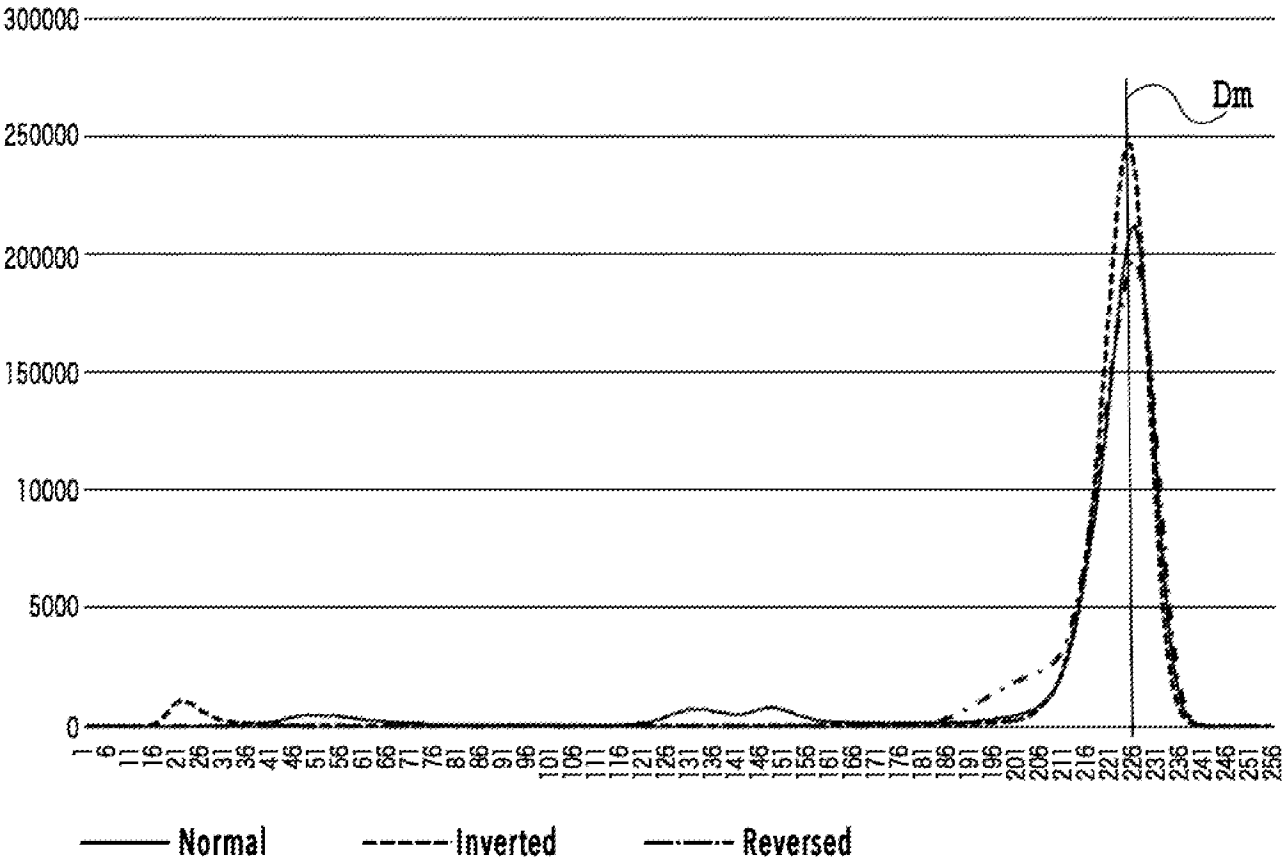
FIG. 13 is a histogram showing an example of a brightness distribution frequency for each pixel in an image analysis range.
Figure 14:
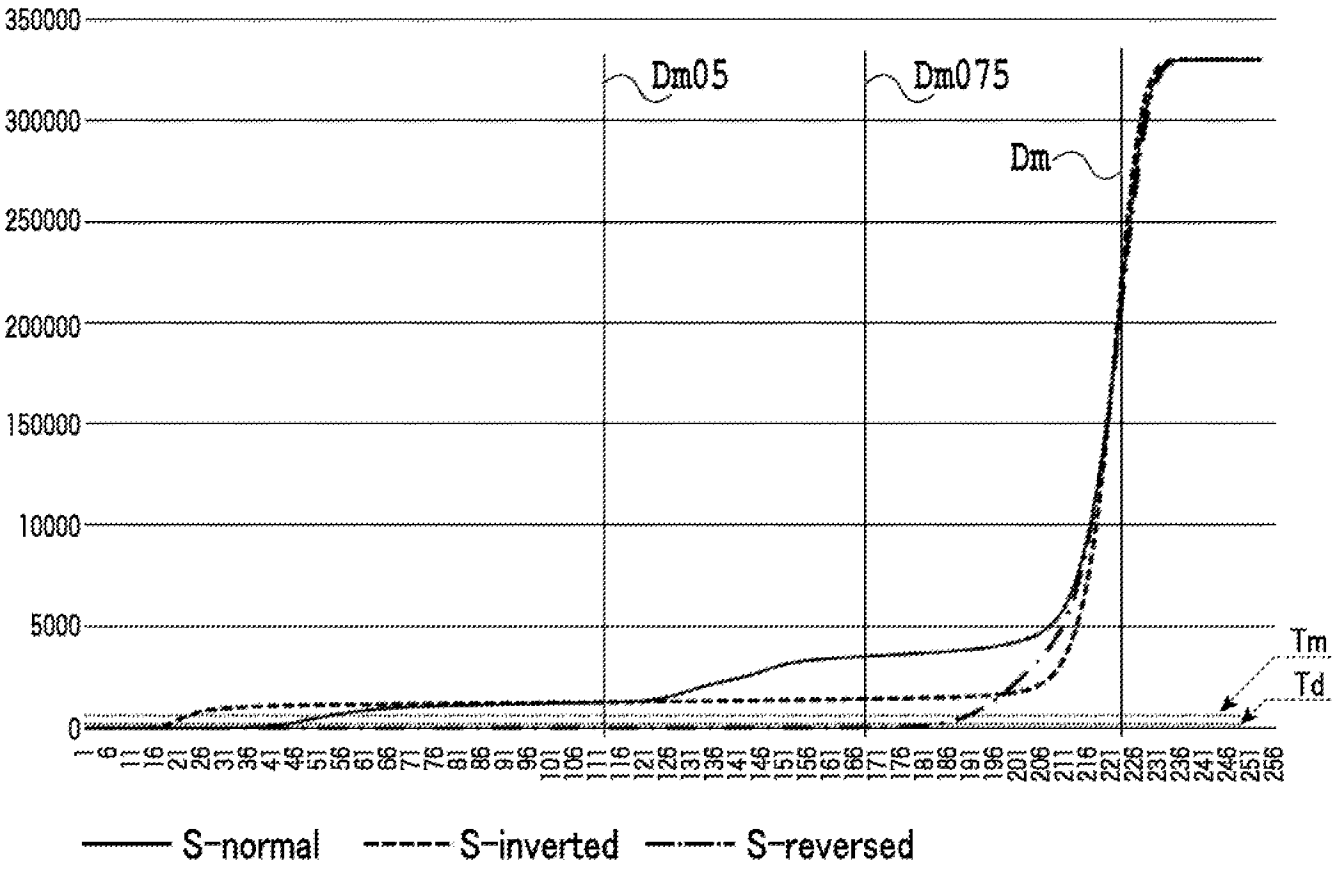
FIG. 14 is a histogram showing an example of an accumulated value of a brightness distribution in an image analysis range.

Here, details of the analysis processing of the registration adjustment pattern at S702 relating to the read image of the head adjustment sheet, which is the feature of the present embodiment, are explained with reference to a flowchart shown in FIG. 9 and head adjustment sheet samples of three different kinds of mounting pattern shown in FIG. 10 to FIG. 12. FIG. 13 is a diagram in which the brightness frequency distribution histogram of each sample is compared to one another and FIG. 14 is a diagram in which the accumulated value of the brightness frequency is compared to one another.

Figure 10:
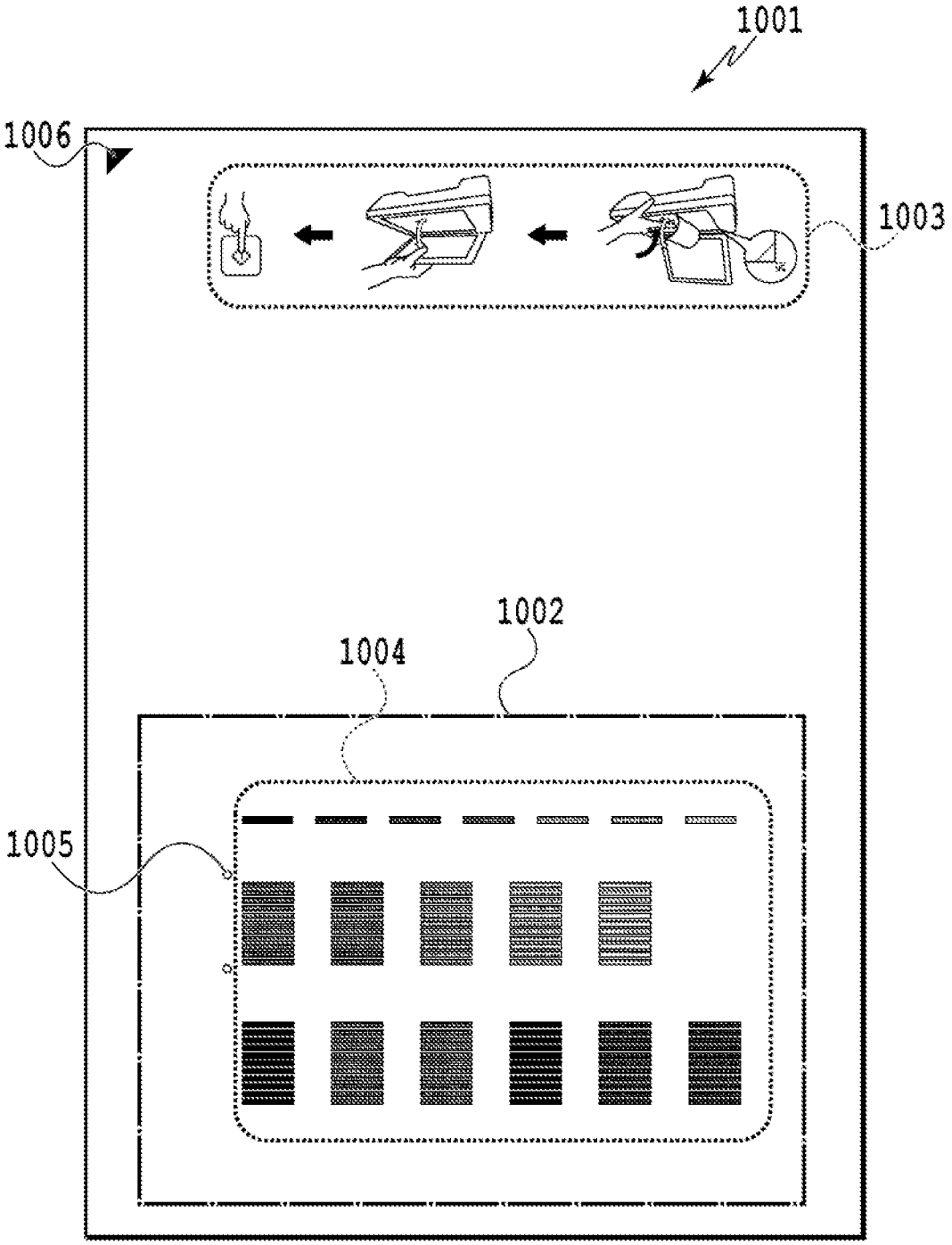
FIG. 10 is an explanatory diagram of a state where a head adjustment sheet is placed correctly.

FIG. 10 is an explanatory diagram of a state where the head adjustment sheet is mounted correctly on the document table 105 (normally placed state). On a head adjustment sheet 1001, a guide illustration 1003 indicating how to mount the head adjustment sheet printed in black ink is laid out on the upper side. On the head adjustment sheet 1001, a position reference mark 1005 printed in black ink and a printing position adjustment pattern 1004 printed in a combination of each color ink are laid out on the lower half side. In a case where the position reference mark 1005 is detected on the lower half side of the read image data, it is identified that the printing medium is one on which the head adjustment sheet is printed. In the present embodiment, on the condition that the position reference mark 1005 is detected, it is made possible for the processing to be advanced to the next processing step that follows the printing position adjustment processing. A mark 1006 in FIG. 10 indicates the position at which the mark 1006 is caused to coincide with the reference position of the document table 105 as shown in the guide illustration 1003.

Figure 11:
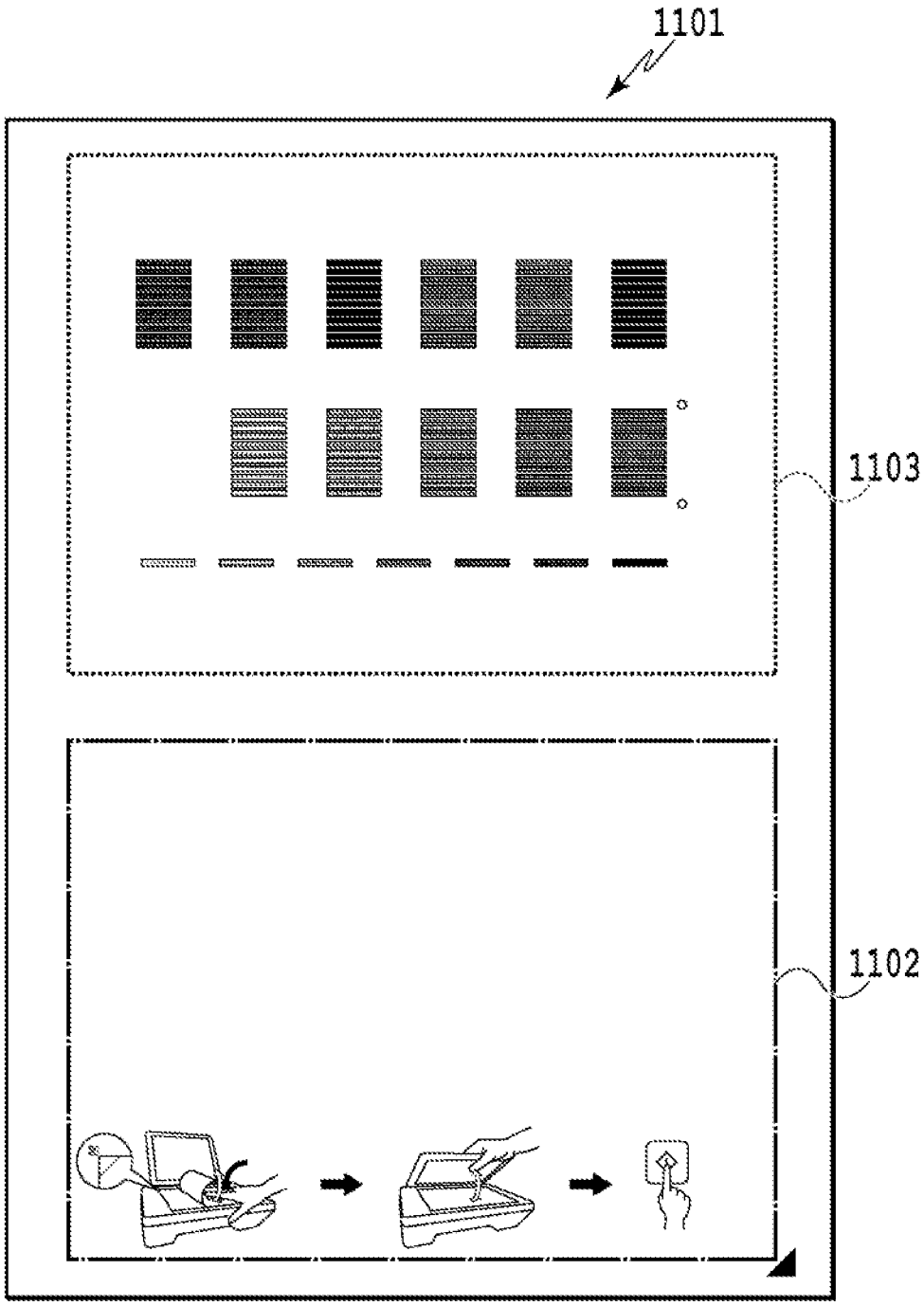
FIG. 11 is an explanatory diagram of a state where a head adjustment sheet is placed invertedly (that is, upside down)

FIG. 11 is an explanatory diagram of a state where the head adjustment sheet is mounted invertedly on the document table 105 (invertedly placed state). On a head adjustment sheet 1101, a guide illustration 1102 is laid out on the lower side. On the head adjustment sheet 1101, a printing position adjustment pattern (hereinafter, also called registration adjustment pattern) 1103 printed in a combination of each color ink is laid out on the upper half side.

Figure 12:
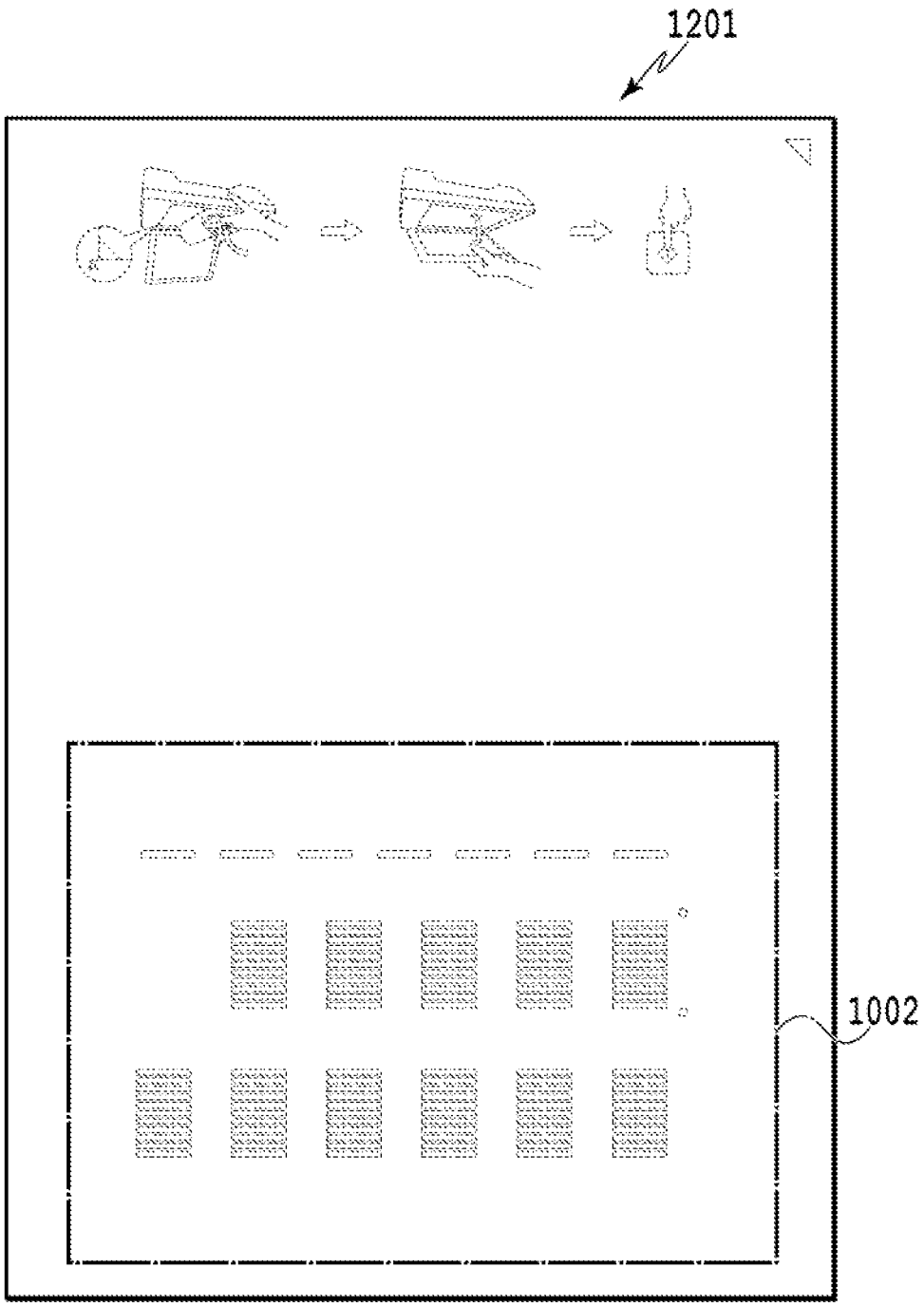
FIG. 12 is an explanatory diagram of a state where a head adjustment sheet is placed reversedly (that is, with surface facing downward)

FIG. 12 is an explanatory diagram of a state where the head adjustment sheet is mounted reversedly on the document table 105 (reversedly placed state). On a head adjustment sheet 1201, on the backside, a range 1002 including the printing position adjustment pattern printed in a combination of each color ink is laid out on the lower half side.

Before the detection processing (S907) of the position reference mark 1005, the CPU 301 performs image processing including creation of histograms of the brightness value and the accumulated value of the brightness value for all the pixels within the analysis range based on the image data of the head adjustment sheet stored in the RAM 303 (S901). Further, it is also possible to take the inside of the range 1002 including the position reference mark 1005 and the printing position adjustment pattern (hereinafter, also called registration adjustment pattern) as the analysis range in the state where the head adjustment sheet is placed correctly (FIG. 10). Due to this, it is possible to reduce the storage area and lighten the processing load, which are necessary for the image processing.

In FIG. 13, histograms in a case where the head adjustment sheet is in the normally placed state (FIG. 10), in a case where the head adjustment sheet is in the invertedly placed state (FIG. 11), and in a case where the head adjustment sheet is in the reversedly placed state (FIG. 12) are shown. A solid line indicated by Normal is the brightness distribution in the normally placed state, a broken line indicated by Inverted is that in the invertedly placed state, and a one-dot chain line indicated by Reversed is that in the reversedly placed state. Brightness Dm whose frequency value is the maximum is adopted as a background brightness analysis value of a printing medium. Further, for the frequency distribution of brightness, the accumulated value for each brightness value from the pixel value 1 on the black side to the pixel value 256 on the white side is derived. In FIG. 14, S-normal is the accumulated value distribution in the normally placed state, S-inverted is that in the invertedly placed state, and S-reversed is that in the reversedly placed state, respectively. The horizontal axis in FIG. 13 and FIG. 14 represents the number of pixels and the vertical axis represents the brightness value.

At S902, the CPU 301 derives the number of pixels whose brightness value is less than or equal to ½ of the background brightness Dm (Dm05) as a number of low-brightness pixels (Rd) based on the histogram shown in FIG. 13, which is created at S901.

At S903, the CPU 301 compares Rd with a low-brightness threshold value (Td) based on which the surface is determined to be a print surface and determines whether Rd is smaller than Td. In a case of determining that Rd is smaller than Td, the CPU 301 advances the processing to S913 and at S913, the CPU 301 determines that the print range is too small and sets a "white sheet error". Here, the white sheet error includes the reversedly placed state of the head adjustment sheet. For Td, a preferred value is determined from a design to be printed on the head adjustment sheet. For example, for the head adjustment sheet 1001 shown in FIG. 10, by deriving Td as Td=T0×0.005 from a total number of pixels T0 within the analysis range 1002, an expected operation is obtained. In a case where of determining that Rd is equal to Td or larger than Td, the CPU 301 advances the processing to S904.

At S904, the CPU 301 derives the number of pixels whose brightness value (Dm075) is less than or equal to ¾ of the background brightness Dm as a number of intermediate-brightness pixels (Rm) based on the histogram shown in FIG. 13, which is created at S901.

At S905, the CPU 301 compares Rm with an intermediate-brightness threshold value (Tm) based on which the surface is determined to be a print surface and determines whether Rm is smaller than Tm. In a case of determining that Rm is smaller than Tm, the CPU 301 advances the processing to S913 and at S913, the CPU 301 determines that the print range is too small and sets the "white sheet error". Here, the reason the determination processing is performed twice at S902 to S905 is explained. The range printed mainly in black ink affects the frequency value of Rd and the range printed in black ink and color ink affects the frequency value of Rm. In a case where only the white sheet is determined simply, although S902 and S903 are not necessary, by performing determination by using the two threshold values, it is made possible to increase the probability of detecting that "the document is not the adjustment sheet". For Tm, a preferred value is determined from a design to be printed on the adjustment sheet. For example, for the head adjustment sheet 1001 shown in FIG. 10, by deriving Tm as Tm=T0×0.01 from the value of the total number of pixels T0 within the analysis range 1002, an expected operation is obtained. In a case of determining that Rm is equal to Tm or larger than Tm, the CPU 301 advances the processing to S906.

At S906, the CPU 301 determines the brightness threshold value for detecting the position reference mark 1005 printed on the printing medium.

At S907, the CPU 301 performs detection processing of the position reference mark 1005 by pattern matching within the analysis range 1002 based on the brightness threshold value determined at S906. As described above, the mark detection processing (S907) is performed based on the background brightness of the used printing medium, and therefore, it is possible to lessen the influence received from the background brightness of the printing medium.

At S908, the CPU 301 determines whether or not the mark is detected. In a case where the mark is not detected (S908: NO), the CPU 301 advances the processing to S914 and sets an "undetected mark" error. NO is determined both at S903 and at S905, and therefore, it has been checked that an image is printed on the sheet placed by a user. That is, it is estimated that the possibility that the adjustment sheet is placed invertedly is strong. That is, by the processing at S903, S905, and S908, detection to detect that reading of the printing medium is performed in the state where the printing medium is inverted (inversion detection) is performed. Because of this, as the preprocessing (S705) for performing the analysis processing (S702) in FIG. 7 again, the CPU 301 rotates the image data of the range 1002 in which the registration adjustment pattern 1004 is located in the invertedly placed state by 180 degrees by digital data processing. Then, following the above, the analysis processing is performed again at S702. In a case where the position reference mark 1005 is detected (S908: YES), the CPU 301 advances the processing to S909.

At S909, the CPU 301 performs an analysis of the printing position adjustment pattern (registration adjustment pattern) based on the relative position information on the position reference mark stored in advance and the printing position adjustment pattern 1004. As the analysis processing of the printing position adjustment pattern at S909, for example, it is possible to apply the technique described in Japanese Patent Laid-Open No. 2011-11381.

At S910, the CPU 301 determines whether the pattern analysis has succeeded. In a case where the analysis of all the printing position adjustment patterns has succeeded (S910: YES), the CPU 301 derives a print adjustment value at S911 and normally terminates the analysis processing of the image data of the head adjustment sheet (S912). In a case where the printing position adjustment pattern analysis has not succeeded (S910: NO), the CPU 301 sets a "sheet analysis error" at S915.

By the attribute of the analysis results, the problems are classified again from the point of view of whether the problem is one that a user can easily cope with at a step, not shown schematically, and an error that is notified (reported) by UI is set. Specifically, in a case where the white sheet error (S913) is set, the CPU 301 reports the error as a "reversed placement error". That is, at S702, detection to detect that reading of the printing medium is performed in the state where the printing medium is reversed (reversion detection) is performed and in a case where that reading of the printing medium is performed in the state where the printing medium is reversed is detected, the CPU 301 reports the error as the "reversed placement error". In a case where the undetected mark error (S914) is set and reading supposing the inverted placement and redoing of the analysis (S605) are not performed yet, the CPU 301 reports the error as an "inverted placement error". On the other hand, in a case where the undetected mark error occurs again after performing inverted placement processing, the CPU 301 reports the error as "other errors". The causes of the sheet analysis error (S915) are wide-ranging and it is not possible to specify a measure that a user should take. Because of this, the CPU 301 reports the error as "other errors".

In accordance with the results of the analysis processing (S702) of the registration adjustment pattern, the process of the subsequent semi-automatic head adjustment is branched. That is, Case 1: case where the analysis has succeeded Case 2: case where the analysis has failed and the error cause is the inverted head adjustment sheet Case 3: case where the analysis has failed and the error cause is the reversed head adjustment sheet Case 4: case where the analysis has failed and the error cause is other than Case 2 and Case 3.

In the following, each Case is explained. In each Case, each function unit is controlled by the CPU 301.

<Case 1: Case where Analysis has Succeeded>

At S703, in a case where the head adjustment sheet 201 is printed correctly, the head adjustment sheet 201 is mounted correctly on the document table 105, and the analysis is performed correctly, the CPU 301 determines that there is no analysis error relating to the registration adjustment pattern. Because of this, the CPU 301 displays a normal termination screen 803 indicating that the semi-automatic head adjustment is completed correctly on the display unit 106 as shown, for example, in FIG. 8C at S710. Following the above, after the printing position adjustment (S504) of the print head is performed, the CPU 301 advances the processing to the post-stage setting (S406), and therefore, in Case 1, the semi-automatic head adjustment is terminated.

In a case where the head adjustment sheet 201 is not analyzed correctly at S703, the analysis error contents are classified at S704. In accordance with the classified error contents (classification results), the operation in Case 2 to Case 4 is performed.

<Case 2: Case where Analysis has Failed and Error Cause is Inverted Head Adjustment Sheet>

In a case where the head adjustment sheet 201 is mounted invertedly on the document table 105, the undetected mark error is set at S914. Because of this, the CPU 301 determines that the error of the analysis results is an error in which the head adjustment sheet 201 is mounted invertedly (inversion error) and the CPU 301 advances the processing to processing to correct the invertedly mounted state (hereinafter, inversion correction processing) (S705). The error in this case is classified into an error that a user can cope with. As the inversion correction processing, the CPU 301 cuts out the image data of the registration pattern range 1103 in the invertedly placed state and performs processing to rotate the image data by 180 degrees. By the above processing, it is possible to automatically continue the processing as it is without requiring the work of a user. Consequently, following S705, the analysis of the registration adjustment pattern at S702 is performed automatically. In this case, by the inversion correction processing at S705, the resumed analysis of the registration adjustment pattern (S702) succeeds, and therefore, as in Case 1, it is determined that there is no analysis error at S703 and the CPU 301 advances the processing to S710.

<Case 3: Case where Analysis has Failed and Error Cause is Reversed Head Adjustment Sheet>

In a case where the head adjustment sheet 201 is mounted reversedly on the document table 105, at S913, the white sheet error is set. Because of this, the CPU 301 determines that the error of the analysis results is an error in which the head adjustment sheet is mounted reversedly (hereinafter, reversion error) and advances the processing to S706. At S706, for example, as shown in FIG. 8E, a reversion error screen 805 is displayed on the display unit 106. The error in this case is classified into an error that a user can cope with. Here, in a case where an OK button in FIG. 8E is pressed down, the processing of the CPU 301 advances to S707 and for example, as shown in FIG. 8F, a key operation waiting screen 806 is displayed on the display unit 106. At S708, the CPU 301 determines whether reading of the head adjustment sheet 201 again is selected or a skip is selected.

In a case where a use mounts the head adjustment sheet 201 again on the document table 105, [OK] is selected on the key operation waiting screen 806, the CPU 301 returns processing to S701, and at S701, the reading processing of the head adjustment sheet 201 is performed again. At this time, on the display unit 106, for example, as shown in FIG. 8A, the reading start check screen 801 is displayed. In a case where a user corrects the reversion of the head adjustment sheet 201 mounted on the document table 105 and then mounts the head adjustment sheet 201 on the document table, the resumed analysis of the registration adjustment pattern (S702) succeeds, and therefore, the CPU 301 advances the processing to Case 1 "case where the analysis has succeeded".

On the other hand, in a case where "Perform later" is selected at S708, the CPU 301 skips the semi-automatic head adjustment in the initial setup and at S709, for example, as shown in FIG. 8D, displays a skip termination screen 804 on the display unit 106. Then, the CPU 301 returns the processing to the semi-automatic head adjustment at S405 and advances the processing to the post-stage setting (S406).

<Case 4: Case where Analysis has Failed and Error Cause is Other than Case 2 and Case 3>

In a case where the sheet analysis error is set at S915, the CPU 301 determines that the error of the analysis results is other errors at S704. The error such as this is classified into an error that a user cannot cope with. In this case, the CPU 301 skips the printing position adjustment (S504) of the semi-automatic head adjustment without displaying anything on the display unit 106. Then, the CPU 301 returns the processing to the semi-automatic head adjustment at S405 and advances the processing to the post-stage setting (S406), which is processing other than the semi-automatic head adjustment included in the initial setup (processing other than adjustment processing). In Case 4, the analysis (S702) of the registration adjustment pattern has failed because of a cause other than the case where a user has not mounted the head adjustment sheet 201 correctly on the document table. Because of this, it is predicted that it is difficult for a user to cope with this cause during the initial setup. In the present embodiment, although the causes of other errors are not specified particularly, there is a case where it is not possible to analyze the registration adjustment pattern correctly because there is stain on the printing sheet used at the time of printing of the head adjustment sheet 201 at S501. In this case, it is necessary to print the head adjustment sheet 201 again by using a printing sheet without stain. Alternatively, there is a case where it is not possible to print the registration adjustment pattern 202 correctly because no ink is ejected from the print head 103, or the like. In this case, it is necessary to solve the no ejection by cleaning the print head 103, and so on. In coping with these cases, it is difficult for a user to check the causes of these cases and to take measures, and therefore, it is desirable to temporarily skip the semi-automatic head adjustment and to advance the initial setup to the end.

In the present embodiment, although explanation is given to the case where a user performs the inversion correction processing, the case is not limited to this. For example, in a case of an ink jet MFP with a configuration in which the inversion correction processing at S705 cannot be performed, specifications may be accepted in which the key operation waiting screen 806 is displayed on the display unit 106 at S707 and a user is reported to cope with the inversion as in Case 3.

Further, in a case where it is possible for the scanner unit 104 of the ink jet MFP 101 to automatically perform a reversion scan to reverse the surface and the backside in the ADF or the like, specifications may be accepted in which the reversion correction processing is performed automatically without requesting a user to cope with the reversion at S707 in Case 3.

Further, in a case of other errors at S704, it may also be possible to cause a user to perform the processing again by displaying the key operation waiting screen 806 such as that at S707 on the display unit 106. It may also be possible to perform the processing again from the reading processing of the head adjustment sheet at S701 or from the printing processing of the head adjustment sheet at S501. Further, it may also be possible to display the skip termination screen 804 on the display unit 106 as at S709 although a user is not caused to perform the processing again.

The error contents determined in the analysis processing of the registration adjustment pattern at S702 may be other contents. For example, it may also be possible to specify a case where the head adjustment sheet 201 is not mounted on the document table 105 and to produce a display for prompting a user to cope with the case as in Case 3 or to request a user to perform the operation again.

As explained above, according to the present embodiment, in a case where it is not difficult for a user to cope with, the user is caused to perform the semi-automatic head adjustment again by a report. In a case where it is difficult for a user to cope with, it is possible to advance the processing to the next item of the initial setup without causing the user to perform the semi-automatic head adjustment again. Due to this, it is possible to complete the initial setup to the end while increasing the success rate of the semi-automatic head adjustment. That is, it is possible to improve usability in the initial setup including the semi-automatic head adjustment.

Figure 15:
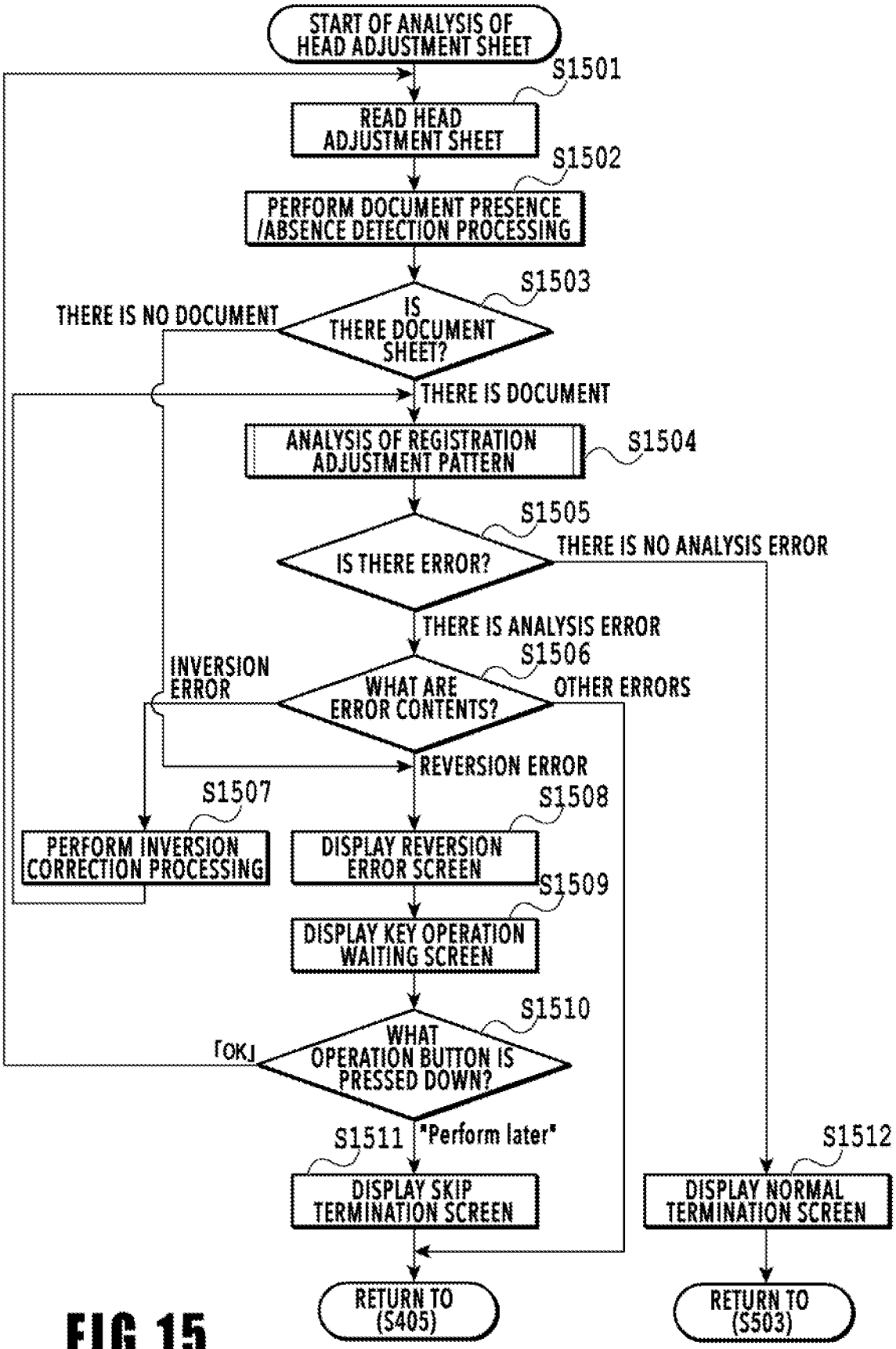
FIG. 15 is a flowchart showing an analysis processing procedure example of a head adjustment sheet.

It is also be possible to determine the presence/absence of a document on the document table 105 prior to the registration pattern analysis processing (S702). That is, it is also possible to determine whether or not a document is mounted on the document table 105. FIG. 15 is a flowchart showing details of an analysis processing procedure example of the semi-automatic head adjustment including document presence/absence detection processing. The processing contents at S1501 and S1504 to S1512 are the same as those at S701 to S710, respectively, and therefore, explanation thereof is omitted. In the flow in FIG. 15, on the read image data obtained by reading the range including the entire surface of the head adjustment sheet 201, prior to registration adjustment pattern analysis (S1504), head adjustment sheet presence/absence detection processing, that is, document presence/absence detection processing (S1502) is performed. It is possible to perform the document presence/absence detection processing on the document table by, for example, detecting the contour of the document. Following the above, at S1503, the presence/absence of the head adjustment sheet is determined based on detection results at S1502. In a case where the head adjustment sheet is detected, the registration adjustment pattern analysis (S1504) is performed. In a case where the head adjustment sheet is not detected, the CPU 301 advances the processing to S1508 and it is taken to be equivalent to a white sheet and for example, as shown in FIG. 8E, the reversion error screen 805 is displayed on the display unit 106. By displaying the screen 805 such as this on the display unit 106, it is possible to report the error situation to a user. Due to this, it may also be possible to request a user to check the document mounted state or to instruct a user to mount the head adjustment sheet on the document table by explicitly notifying a user (giving a user a report) of a state where mounting of a document is forgotten. In a case where the existence of the head adjustment sheet is checked at S1502, the CPU 301 advances the processing to S1503 and the same processing as that in the flowchart shown in FIG. 7 is performed.

Second Embodiment

In the above-described first embodiment, the reading processing is performed for the range including the entire area of the surface of the head adjustment sheet 201 mounted on the document table 105 at S701. Note that, in a case where the range including the entire area of the surface of the head adjustment sheet is read at a resolution necessary for the analysis processing of the registration adjustment pattern of the head adjustment sheet, there is a case where the size of the acquired image data exceeds the capacity of the image memory, and therefore, it is not possible to save the image data.

Consequently, in the present embodiment, an operation flow is explained, which is capable of detecting an inversion error even in a case where the head adjustment sheet is placed invertedly in an MFP including a small-capacity image memory. Explanation of the contents in common to those of the first embodiment is omitted or simplified and in the following, the reading processing of the head adjustment sheet and the processing at the time of the occurrence of an inversion error, which are different points, are explained.

Figure 16:
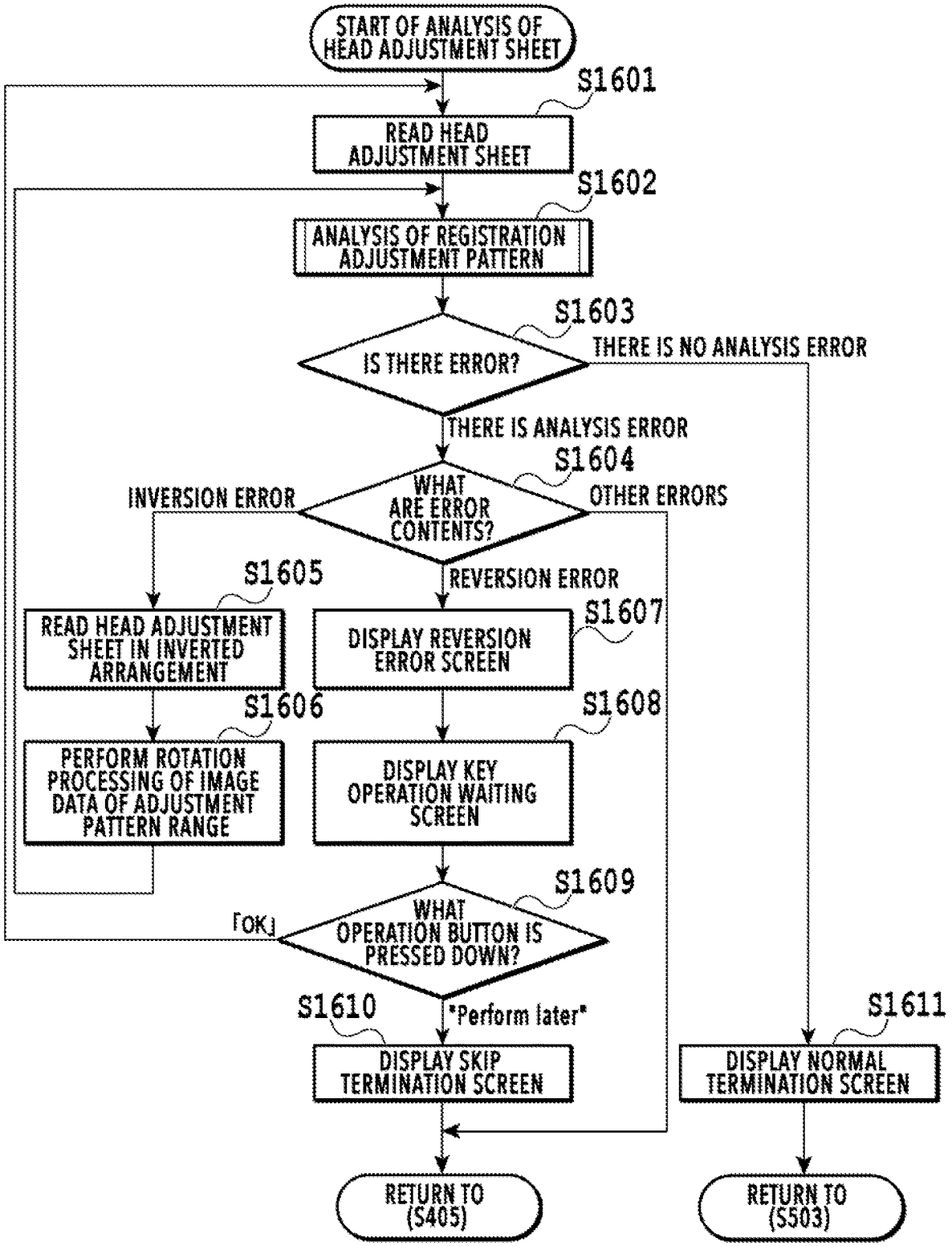
FIG. 16 is a flowchart showing an analysis processing procedure example of a head adjustment sheet.

A detailed flow of the analysis processing procedure of the head adjustment sheet, which is the feature of the present embodiment, is explained in detail in accordance with the flowchart shown in FIG. 16. At S1601, the CPU 301 performs reading processing only for the range 1002, which is a part of the document sheet, including the range of the registration adjustment pattern 1004 of the head adjustment sheet mounted correctly on the document table 105 as shown in FIG. 10. The CPU 301 skips the reading processing from the start of movement of the scanner unit 104 until the range 1002 is reached. The MFP stores, for example, how many seconds are taken from (a predetermined time that elapses after) the start of movement of the scanner unit 104 until the range 1002 is reached in a case where the head adjustment sheet is mounted correctly. Because of this, it is possible for the CPU 301 to perform S1601 by performing the reading processing after the predetermined time from the start of movement of the scanner unit 104 based on the above-described stored information.

At S1602, the CPU 301 performs the analysis processing of the registration adjustment pattern for the image data acquired at S1601. At this time, on the display unit 106 of the ink jet MFP 101, for example, the reading-in-progress screen 802 is displayed as shown in FIG. 8B.

In accordance with the results of the registration pattern analysis at S1602, the process of the semi-automatic head adjustment after S1602 is branched. That is, Case 1: case where the analysis has succeeded Case 2: case where the analysis has failed and the error cause is the inverted head adjustment sheet Case 3: case where the analysis has failed and the error cause is the reversed head adjustment sheet Case 4: case where the analysis has failed and the error cause is other than Case 2 and Case 3.

Here, Case 2, which is the feature of the present embodiment, is explained. Case 1, Case 3, and Case 4 are the same as those in the first embodiment, and therefore, explanation thereof is omitted.

<Case 2: Case where Analysis has Failed and Error Cause is Inverted Head Adjustment Sheet>

In a case where the head adjustment sheet 201 is mounted invertedly on the document table 105, the undetected mark error is set at S914. Because of this, the CPU 301 determines an inversion error at S1604. Here, the processing of the CPU 301 advances to reading processing (S1605) of the registration adjustment pattern (1103 in FIG. 11) in a case where inverted placement is supposed. That is, the CPU 301 performs reading processing as well as starting movement of the scanner unit 104 for reading only the range 1103. Then, the CPU 301 rotates the image data including the registration adjustment pattern read by the reading processing at S1605 by 180 degrees by the digital image processing (S1606). By S1606, the same image data as that of the registration adjustment pattern (1002 in FIG. 10) of the head adjustment sheet placed at the correct position is obtained. This processing does not require the work of a user in particular, and therefore, the processing is continued automatically as it is and the reading of the head adjustment sheet (S1601) and the analysis of the registration adjustment pattern (S1602) are performed automatically. That is, the reading area is changed. By the inversion correction processing combining S1605 and S1606, the resumed analysis of the registration adjustment pattern (S1602) succeeds, and therefore, the CPU 301 advances the processing to advance to "Case 1: case where the analysis has succeeded" as a result.

According to the present embodiment, it is possible to perform any of the analysis processing using the range 1002 of the head adjustment sheet in the normally placed state and the analysis processing using the range 1103 of the head adjustment sheet in the invertedly placed state with a small-capacity image memory without the operation of a user. Further, although the image reading with the setting of a high resolution necessary for the analysis of the registration adjustment pattern 1004 requires a long reading time, it is possible to obtain the effect that the reading time can be reduced by limiting the registration pattern reading range to a part thereof (1002 or 1103).

Furthermore, in the analysis processing of the analysis range of the registration adjustment pattern, it is also possible to explicitly determine inverted placement by detecting an illustration image in the analysis range 1102, in addition to a method of determining that there is a possibility of inverted placement from the density distribution as explained in the first embodiment. Although the illustration image to be detected is stored in advance in the nonvolatile memory of the apparatus in accordance with the layout of the head adjustment sheet, it may also be possible to include a mark for detecting inverted placement in an illustration design.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present embodiment, it is possible to improve usability in an initial setup including semi-automatic head adjustment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-145449 filed Aug. 1, 2018, which is hereby incorporated by reference wherein in its entirety.

What is claimed is:

1. A printing apparatus comprising a reading unit configured to read a printing medium on which a pattern for adjusting a printing position of a print head is printed and a display unit configured to display information in accordance with reading results of the reading unit, and in which a setup including adjustment processing of the print head is performed, the printing apparatus having:

an analysis unit configured to analyze whether there is an error relating to the pattern based on image data read by the reading unit;

a classification unit configured to classify whether an error of analysis results by the analysis unit is an error that a user can cope with; and a control unit configured to perform control to, in a case where an error of classification results by the classification unit is an error that a user can cope with, display a coping method thereof on the display unit, and to, in a case where an error of classification results by the classification unit is not an error that a user can cope with, advance processing to processing other than adjustment processing of the print head, which is included in the setup, without adjusting a printing position of the print head.

2. The printing apparatus according to claim 1, comprising:

a reversion detection unit configured to detect that reading of the printing medium is performed in a state where the printing medium is reversed, wherein the control unit displays, in a case where the reversion detection unit detects that reading of the printing medium is performed in a state where the printing medium is reversed, a coping method thereof on the display unit.

3. The printing apparatus according to claim 1, comprising:

a document presence/absence detection unit configured to detect that reading of the printing medium is performed in a state where the printing medium does not exist, wherein the control unit displays, in a case where the document presence/absence detection unit detects that reading of the printing medium is performed in a state where the printing medium does not exist, a coping method thereof on the display unit.

4. The printing apparatus according to claim 1, comprising:

an inversion detection unit configured to detect that reading of the printing medium is performed in a state where the printing medium is inverted, wherein the control unit displays, in a case where the inversion detection unit detects that reading of the printing medium is performed in a state where the printing medium is inverted, a coping method thereof on the display unit.

5. The printing apparatus according to claim 1, comprising:

an inversion detection unit configured to detect that reading of the printing medium is performed in a state where the printing medium is inverted, wherein the control unit automatically performs, in a case where the inversion detection unit detects that reading of the printing medium is performed in a state where the printing medium is inverted, reading of the printing medium by the reading unit by inverting the printing medium.

6. The printing apparatus according to claim 1, wherein the display unit displays a screen for causing a user to select performing reading of the printing medium again or skipping reading of the printing medium.

7. The printing apparatus according to claim 1, wherein the control unit displays that adjustment of a printing position of the print head is performed on the display unit in a case of adjusting a printing position of the print head based the analysis results and advancing processing to next processing on a condition that the analysis results are not an error, and displays that adjustment of a printing position of the print head is skipped in a case of advancing processing to next processing without performing adjustment of a printing position of the print head.

8. The printing apparatus according to claim 7, wherein in a case of skipping adjustment of a printing position of the print head and advancing processing to next processing, the control unit:

displays that adjustment of a printing position of the print head is skipped on the display unit on a condition that adjustment of a printing position of the print head is skipped by a user operation; and does not display that adjustment of a printing position of the print head is skipped on the display unit on a condition that adjustment of a printing position of the print head is skipped automatically.

9. The printing apparatus according to claim 8, wherein the control unit also displays, in a case of displaying that adjustment of a printing position of the print head is skipped on the display unit, a method of manually starting adjustment of a printing position of the print head after a setup is terminated.

10. The printing apparatus according to claim 1, comprising:

an inversion detection unit configured to detect that reading of the printing medium is performed in a state where the printing medium is inverted, wherein the control unit performs, in a case where the inversion detection unit detects that reading of the printing medium is performed in a state where the printing medium is inverted and it is not possible to perform adjustment of a printing position of the print head again by analysis of the image data, reading by reading unit again by automatically changing a reading area of the printing medium so that adjustment of a printing position of the print head is performed again based on the image data obtained by performing the reading again.

11. A control method of a printing apparatus comprising a reading unit configured to read a printing medium on which a pattern for adjusting a printing position of a print head is printed and a display unit configured to display information in accordance with reading results of the reading unit, and in which a setup including adjustment processing of the print head is performed, the control method comprising:

analyzing whether there is an error relating to the pattern based on image data read by the reading unit;

classifying whether an error of analysis results by the analyzing is an error that a user can cope with; and performing control to, in a case where an error of classification results by the classifying is an error that a user can cope with, display a coping method thereof on the display unit, and to, in a case where an error of classification results by the classifying is not an error that a user can cope with, advance processing to processing other than adjustment processing of the print head, which is included in the setup, without adjusting a printing position of the print head.

12. The control method according to claim 11, further comprising:

detecting that reading of the printing medium is performed in a state where the printing medium is reversed, wherein in a case where it is detected that reading of the printing medium is performed in a state where the printing medium is reversed, a coping method thereof is displayed on the display unit.

13. The control method according to claim 11, further comprising:

detecting that reading of the printing medium is performed in a state where the printing medium does not exist, wherein in a case where it is detected that reading of the printing medium is performed in a state where the printing medium does not exist, a coping method thereof is displayed on the display unit.

14. The control method according to claim 11, further comprising:

detecting that reading of the printing medium is performed in a state where the printing medium is inverted, wherein in a case where it is detected that reading of the printing medium is performed in a state where the printing medium is inverted, a coping method thereof is displayed on the display unit.

15. The control method according to claim 11, further comprising:

detecting that reading of the printing medium is performed in a state where the printing medium is inverted, wherein in a case where it is detected that reading of the printing medium is performed in a state where the printing medium is inverted, reading of the printing medium by the reading unit is performed automatically by inverting the printing medium.

16. The control method according to claim 11, wherein the display unit displays a screen for causing a user to select performing reading of the printing medium again or skipping reading of the printing medium.

17. The control method according to claim 11, wherein that adjustment of a printing position of the print head is performed is displayed on the display unit in a case where a printing position of the print head is adjusted based the analysis results and next processing is performed on a condition that the analysis results are not an error, and that adjustment of a printing position of the print head is skipped is displayed on the display unit in a case where next processing is performed without performing adjustment of a printing position of the print head.

18. The control method according to claim 17, wherein:

in a case where adjustment of a printing position of the print head is skipped and next processing is performed:

that adjustment of a printing position of the print head is skipped is displayed on the display unit on a condition that adjustment of a printing position of the print head is skipped by a user operation; and that adjustment of a printing position of the print head is skipped is not displayed on the display unit on a condition that adjustment of a printing position of the print head is skipped automatically.

19. The control method according to claim 11, further comprising:

detecting that reading of the printing medium is performed in a state where the printing medium is inverted, wherein in a case where it is detected that reading of the printing medium is performed in a state where the printing medium is inverted and it is not possible to perform adjustment of a printing position of the print head again by analysis of the image data, reading by reading unit is performed again by automatically changing a reading area of the printing medium so that adjustment of a printing position of the print head is performed again based on the image data obtained by performing the reading again.

20. A non-transitory computer readable storage medium storing a program for causing a computer to perform a control method of an ink jet printing apparatus comprising a reading unit configured to read a printing medium on which a pattern for adjusting a printing position of a print head is printed and a display unit configured to display information in accordance with reading results of the reading unit, and in which a setup including adjustment processing of the print head is performed, the control method comprising:

analyzing whether there is an error relating to the pattern based on image data read by the reading unit;

classifying whether an error of analysis results by the analyzing is an error that a user can cope with; and performing control to, in a case where an error of classification results by the classifying is an error that a user can cope with, display a coping method thereof on the display unit, and to, in a case where an error of classification results by the classifying is not an error that a user can cope with, advance processing to processing other than adjustment processing of the print head, which is included in the initial setup, without adjusting a printing position of the print head.

* * * * *